US009185955B2

(12) United States Patent
Marley et al.

(10) Patent No.: US 9,185,955 B2
(45) Date of Patent: Nov. 17, 2015

(54) FLEXIBLE JEWELRY COVER

(71) Applicants: Angela Marley, Newtown, PA (US); Francesca Haller, Newtown, PA (US); Victor Lazzaro, Fremont, CA (US)

(72) Inventors: Angela Marley, Newtown, PA (US); Francesca Haller, Newtown, PA (US); Victor Lazzaro, Fremont, CA (US)

( * ) Notice: Subject to any disclaimer, the term of this patent is extended or adjusted under 35 U.S.C. 154(b) by 182 days.

(21) Appl. No.: 13/972,593

(22) Filed: Aug. 21, 2013

(65) Prior Publication Data

US 2015/0053578 A1 Feb. 26, 2015

(51) Int. Cl.

| | |
|---|---|
| ***A44C 9/00*** | (2006.01) |
| ***A44C 15/00*** | (2006.01) |
| ***A45C 11/16*** | (2006.01) |

(52) U.S. Cl.

CPC . *A45C 11/16* (2013.01); *A44C 9/00* (2013.01); *A44C 9/0092* (2013.01); *A44C 15/00* (2013.01)

(58) Field of Classification Search

None

See application file for complete search history.

(56) References Cited

U.S. PATENT DOCUMENTS

| | | | | |
|---|---|---|---|---|
| 417,569 | A | | 12/1889 | Margileth |
| 732,532 | A | | 6/1903 | Fallek |
| 1,533,441 | A | | 4/1925 | George |
| 1,628,278 | A | | 5/1927 | Sydney |
| 1,885,930 | A | | 11/1932 | James |
| 2,584,270 | A | * | 2/1952 | Hucknall ..... 368/281 |
| 3,656,244 | A | | 4/1972 | Andrade |
| 3,700,148 | A | * | 10/1972 | Lanvin ..... 224/170 |
| 3,880,426 | A | | 4/1975 | Morse |
| 3,994,025 | A | | 11/1976 | Petroski |
| 4,215,556 | A | | 8/1980 | Mroz |
| 4,377,079 | A | | 3/1983 | Krueger |
| 4,845,777 | A | | 7/1989 | Mersinas |
| 4,908,881 | A | | 3/1990 | Field |
| 5,272,682 | A | * | 12/1993 | Falcone ..... 368/281 |
| 6,023,786 | A | | 2/2000 | Burnett |
| 6,094,747 | A | | 8/2000 | Malick |
| 6,481,244 | B1 | | 11/2002 | Wright |
| 6,513,685 | B1 | | 2/2003 | Tzoubris |
| 6,925,653 | B1 | | 8/2005 | King |
| 7,055,177 | B2 | | 6/2006 | Svrcek |
| 7,249,385 | B2 | | 7/2007 | Schukraft |
| 7,654,111 | B2 | | 2/2010 | Alley et al. |
| 8,209,771 | B1 | | 7/2012 | Sykes |
| 2006/0144083 | A1 | | 7/2006 | Layton |

* cited by examiner

*Primary Examiner* — Jack W Lavinder

(74) *Attorney, Agent, or Firm* — IP Works, PLLC

(57) ABSTRACT

A flexible, durable, comfortable, cost-effective, easy-on, easy-off flexible jewelry cover completely envelopes jewelry articles and elements extending from said articles, preventing the user from scratching, abrading, or otherwise harming other people or articles he may touch. Further, the cover protects the jewelry articles from unwanted, damaging, and messy substances. The cover may be adapted for use on any appendage, including, but not limited to, fingers, toes, wrists, ankles, hands, and feet. Due to the durable, yet flexible material, the cover fits comfortably on any appendage and does not restrict bodily movements. The cover will not pierce or puncture exterior layers of clothing such as gloves and socks. The cover is also disposable, therefore promoting sanitary conditions.

19 Claims, 13 Drawing Sheets

FLEXIBLE JEWELRY COVER

FIELD OF INVENTION

The present invention relates to a jewelry cover prevents jewelry from abrading people and surfaces it touches, and protects exposed jewelry articles from foreign substances and damage. More specifically, the present invention provides a flexible, durable, comfortable, disposable, and cost effective strip that is easily applied to and removed from said jewelry article and the user's appendage.

BACKGROUND OF THE INVENTION

Rings, jewelry, bands, and similar accessories are all constantly exposed to the elements and messy substances. Jewelry articles worn on all appendages, including toe-rings and other foot-worn decorations, are susceptible to harmful substances in addition to routine wear and tear. Substances can damage jewelry, thus negatively affecting its value, as well as damage its cosmetic appeal.

Further, jewelry can inadvertently harm people and items, as well as puncture or damage gloves or other clothing. Innocuous contact with another can potentially lead to a hurtful scratch or cut from a sharp edge of a jewelry article. People employed in jobs requiring frequent use of hands and physical contact, such as physical therapists or dental hygienists, risk harming a patient every time they touch. These medical professionals may place latex gloves over their jewelry, but sharp edges can snag and pierce the gloves, rendering them useless. Further, tools and utensils are subject to scratching, abrasions, and similar damage whenever someone wearing jewelry uses them. As users continuously contact others there is an ever-growing need for a cover to protect the jewelry and similar accessories. Although there are many covers known in the art for use in protecting jewelry articles, none resolve all of the problems solved by the present invention.

For instance, there are many known casings that specifically cover finger-worn articles. Although these casings are protective, they are rigid and typically made of hard plastics. These hard materials hinder flexibility, thus restricting movement of the hand or finger. Due to their rigidity and inflexibility, hard casings are uncomfortable and even abrasive.

Other covers made of more pliable materials can also restrict movement. These pliable covers may not secure to an appendage as well as covers made of rigid materials. To compensate for this lack of stability, known pliable covers wrap around several appendages even though the jewelry intended to be protected fits on a single digit. For instance, there are known jewelry covers that teach leather straps wrapped around a finger to protect a ring, but further include a separate element worn around the user's wrist or palm. A support element then connects the finger wrap and wrist or palm wrap elements. Ultimately, three (and sometimes more) strap pieces combine in the same cover device to provide the necessary stability. These cumbersome covers and may not provide the same level of protection as their rigid counterparts and yet still limit the user's movement.

Additional covers known in the art have similarly complicated assemblies. Many covers stay in place by chains connecting the cover to a wristband element. These chains are typically structurally weak; should any one link snap, the cover will detach and expose the jewelry. Therefore, even more intricate jewelry covers do not lead to enhanced jewelry protection. The more parts a cover has, the more it may restrict movement, and the more difficult it may be to apply to an appendage. Jewelry covers having fewer structural and interrelated elements are likelier to result in easy-on, easy-off application as opposed to those with a greater number of parts.

Further, as the number of parts increases, so does the cost of the cover. Fewer components leads to cheaper manufacturing costs and allows suppliers to provide an inexpensive product to the consumer. Reducing the number of elements lessens the need for repair and maintenance opportunities, therefore lowering future costs as well.

Many covers intended for multiple uses accrue dirt and remnants of harmful substances. Constant cleaning of the cover can be costly and abrasive cleaners may wear away protective coverings. Cursory cleanings allow residue of the harmful substance to remain on the cover. Unclean covers can harbor germs and lead to dirtier, more harmful substances than the very materials the covers intend to protect against. Disposing of the cover after a finite number of uses prevents unsanitary covers from contacting jewelry and spreading to the user. Many of the covers already described, especially those made of costlier materials like leather, or those with elaborate chain elements, are meant for repeated uses. Disposable covers have a far greater chance of promoting sanitary conditions than nondisposable ones.

Many jewelry covers in the art have the disadvantage of being specifically tailored to articles worn on the finger or wrist. Usually, jewelry covers protect rings and precious gems lodged in finger or hand worn articles but are not adapted to protect articles worn on other appendages. Covers employing multiple strap elements, chains, or hard plastics are cumbersome enough to use on a hand, let alone a toe, ankle, or foot. Toe-rings and foot-worn jewelry must remain exposed and cannot receive the protective benefits of known jewelry covers.

Another disadvantage of known jewelry covers, especially those made of hard materials, is their tendency to damage additional layers of clothing. A hard jewelry cover may pierce a latex glove intended to be worn over the jewelry cover. Covers with chains or other protruding elements may catch, puncture, and/or tear fabric gloves or socks. When a user puts on a jacket or shirt, known covers can catch on to the fabric and damage the clothing or fall off from the appendage and expose the jewelry.

Therefore, there is a need in the art for a jewelry cover that protects people and articles from scratches, damage, and general harm; does not damage, pierce, puncture, snag, or tear other articles of clothing; protects jewelry articles from unwanted substances; is made of a durable, flexible material that can be worn on any appendage; provide easy-on, easy-off application and detachment; is comfortable to the wearer; is cost-effective; and is disposable.

SUMMARY OF THE INVENTION

In order to meet the need in art for a jewelry cover that protects people and articles from scratches, damage, and general harm; does not damage, pierce, puncture, snag, or tear other articles of clothing; protects jewelry articles from unwanted substances; is made of a durable, flexible material that can be worn on any appendage; provide easy-on, easy-off application and detachment; is comfortable to the wearer; is cost-effective; and is disposable, the present invention has been devised.

The present invention is a flexible elongate strip adapted to wrap around a jewelry article worn on a user's appendage. In this context, an appendage includes any body part that receives a jewelry article; typically, but not limited to, a finger or a toe, and can further include a hand, palm, foot, wrist, or ankle. Jewelry articles are not limited to cosmetic decorations of great monetary or sentimental value, but rather may include any accessory worn on any appendage.

The strip is substantially flat and typically does not resemble an exact geometric shape. However, the strip can be any known shape provided it wraps around an appendage. To maintain necessary flexibility and durability, the strip is typically made of silicone, but can be made of any similarly durable and flexible material that prevents the penetration of messy and/or harmful substances, including, but not limited to, rubber, plastic, and fabric.

Regardless of its shape and material, the strip does not have corners or edges sharp enough to puncture a latex glove or catch on a piece of fabric clothing. Due to the strip's durability, the user can wrinkle and place it in his pocket or purse without risk of damaging, creasing, or tearing. The flexible material provides smooth, comfortable contact with the user's skin and does not hinder movement.

Further, the smooth material allows the user to physically contact other people without harming them. For instance, users engaging in regular physical contact with others, such as the aforementioned physical therapists and dental hygienists, can use the jewelry cover to protect their patients from the sharp edges of jewelry articles when the present invention is in use, and at the same time protect their jewelry and prevent tearing, snagging, piercing, or puncturing of gloves. The material's flexibility also allows users to move their appendages without hindering motion, so people can work without having to deal with cumbersome jewelry covers. These are clear advantages over known jewelry covers, especially covers made of rigid materials.

A typical embodiment comprises a strip having two ends, usually referred to as a first end and a second end, with both ends generally rounded at the corners. The portion of strip connecting the two ends has generally parallel straight edges. Positioned towards the first end in the preferred embodiment is a substantially hollow housing having a cross-sectional shape. This housing protrudes from the top side of the strip and is covered on all sides and on top by walls made of the same material as the strip. It has a cross-sectional shape adapted to receive at least one precious stone, gem, or similar element protruding from a jewelry article. Although bounded by walls and a top, the housing has no base; the bottom surface of the strip opens such that its inner walls are exposed. The inside surfaces of the walls and top define a cavity occupied by protruding elements from jewelry articles when the cover is worn. The housing of the preferred embodiment is adapted to receive at least one such protruding element of a jewelry article.

In many embodiments, a lip surrounds the base of the housing, i.e. where the housing begins protruding from the top surface of the strip. This lip extends the cross-sectional shape of the housing past the generally parallel straight edges of the strip. To best accept all shapes and sizes of protruding jewelry elements, the housing's cross-sectional shape is substantially elliptical or oval-shaped. Further, the lip separates the first end with the straight, middle portion of the strip.

Another major feature of the present invention is the securement means. The securement means secures the jewelry cover to the appendage while in use. Most embodiments employ a throughhole adapted to closely receive the housing. Even in the absence of additional securement means elements, this configuration conceals the jewelry article and still maintains a tight, comfortable fit around the appendage.

The throughhole is positioned towards the second end of the strip, opposite the end in which the housing protrudes. The throughhole extends longitudinally through the entire thickness of the strip and has substantially the same cross-sectional shape as the housing. When the strip is in use, the housing covers the jewelry article; the middle portion of strip wraps around the appendage; the throughhole wraps back to the housing; and the housing extends through the throughhole. Since the throughhole is substantially the same cross-sectional shape as the housing, it too has an outer lip that extends the outer edge of the strip. This lip separates the second end of the strip with the middle portion.

Many different kinds of securement means may be used to provide added stability to the strip. Snaps, buttons, adhesives, and clasps, either used individually, in combination, with the throughhole, or independent of the throughhole, all provide means of ensuring the cover has a tight, comfortable fit around the appendage.

One such securement means includes at least one raised protrusion extending from the top surface of the strip, similar to how the housing extends from the top surface of the strip. This protrusion has its own cross-sectional shape. The present invention does not require that the protrusion and housing have substantially similar cross-sectional shapes. The protrusion is positioned in proximity to the housing, opposite the first end of the strip. The protrusion is preferably laterally disposed relative to the strip, i.e. oriented substantially at a right angle relative to the parallel edges of the strip. Most embodiments utilize at least one protrusion.

The protrusion is adapted to fit inside an opening positioned near the second end of the strip. The opening is a hole or slit extending longitudinally through the entire thickness of the strip, similar to the throughhole. The opening is positioned between the second end of the strip and the throughhole adapted to receive the housing when the strip is in use. This contrasts from the protrusion which is not between the first end and housing, but located on the side of the housing closer to the parallel edges.

There is at least one opening for every protrusion. To maximize securement, the opening has substantially the same cross-sectional shape as the protrusion, as the opening is adapted to closely receive the protrusion. When in use, the throughhole of the present invention will receive the housing, and each opening will receive exactly one protrusion. The total number of openings may exceed the number of protrusions so the user can adjust the band as needed for comfort. Although the throughhole fits over the housing, the flexible material may stretch as needed with the extra openings. The strip becomes more secure around the user's appendage and jewelry article as the number of protrusions and openings increases.

The following description best describes the present invention's functionality: a user places a jewelry article on an appendage; for example, an engagement ring having at least one precious stone is placed on a finger. The housing accepts the stone such that the cavity defined by the inner surfaces of the housing envelopes the entire stone. The middle portion of strip wraps around the user's finger such that the bottom surface of the strip contacts the ring or band. The strip wraps around the entire ring leaving no portion of the ring exposed. To secure the cover in place, the throughhole is brought towards and placed over the housing. The throughhole closely receives the housing since they have the same cross-sectional shape. This configuration completely covers the engagement ring, therefore protecting it from damaging substances, as well as scratching anyone or anything. With the housing now extended through the throughhole, the second end of the strip provides added securement when at least one protrusion slots into at least one opening.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention. These and other constructions will become obvious to those skilled in the art from the following drawings and detailed description of the preferred embodiment.

DETAILED DESCRIPTION OF THE PREFERRED EMBODIMENTS

The following detailed description and corresponding drawings are of the best currently contemplated modes of carrying out exemplary embodiments of the invention. The description is not to be taken in a limiting sense, but is made for the purpose of illustrating the general principles of the invention.

Figure 1:
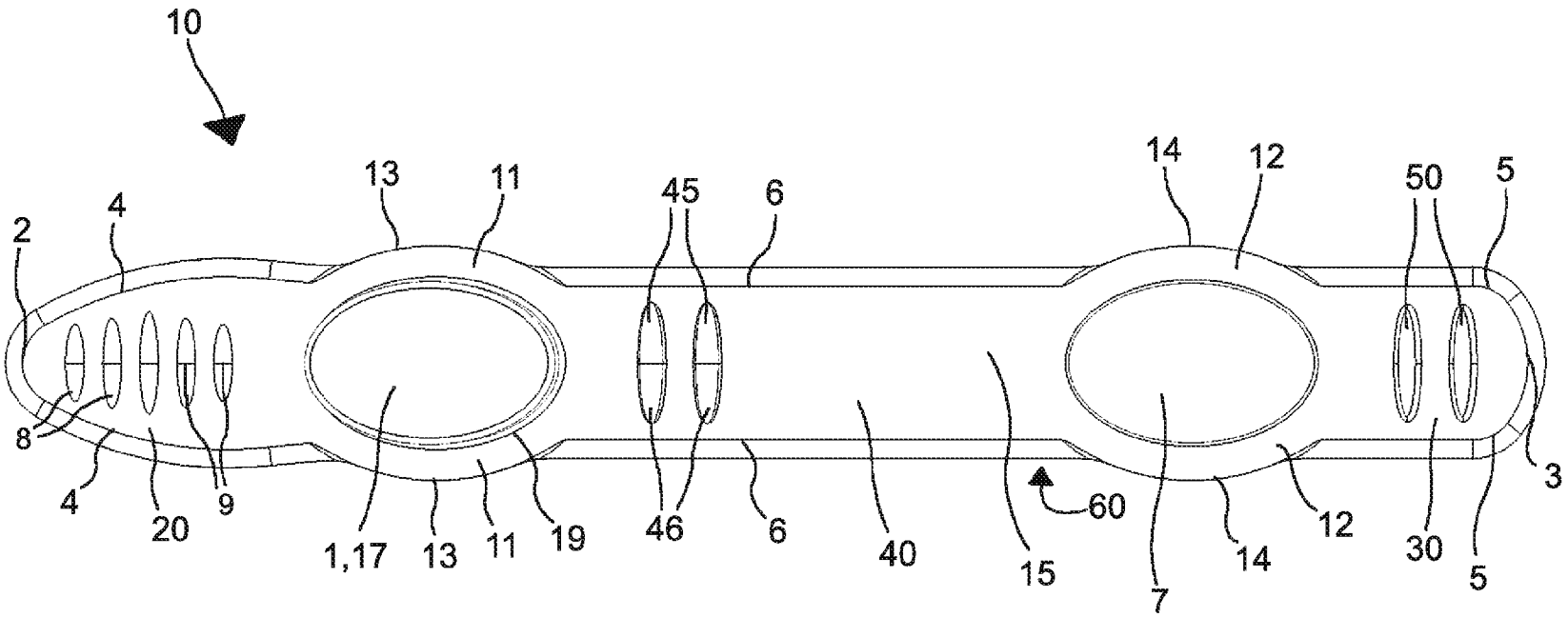
FIG. 1 is a top plan view of the preferred embodiment of the present invention.
Figure 3:
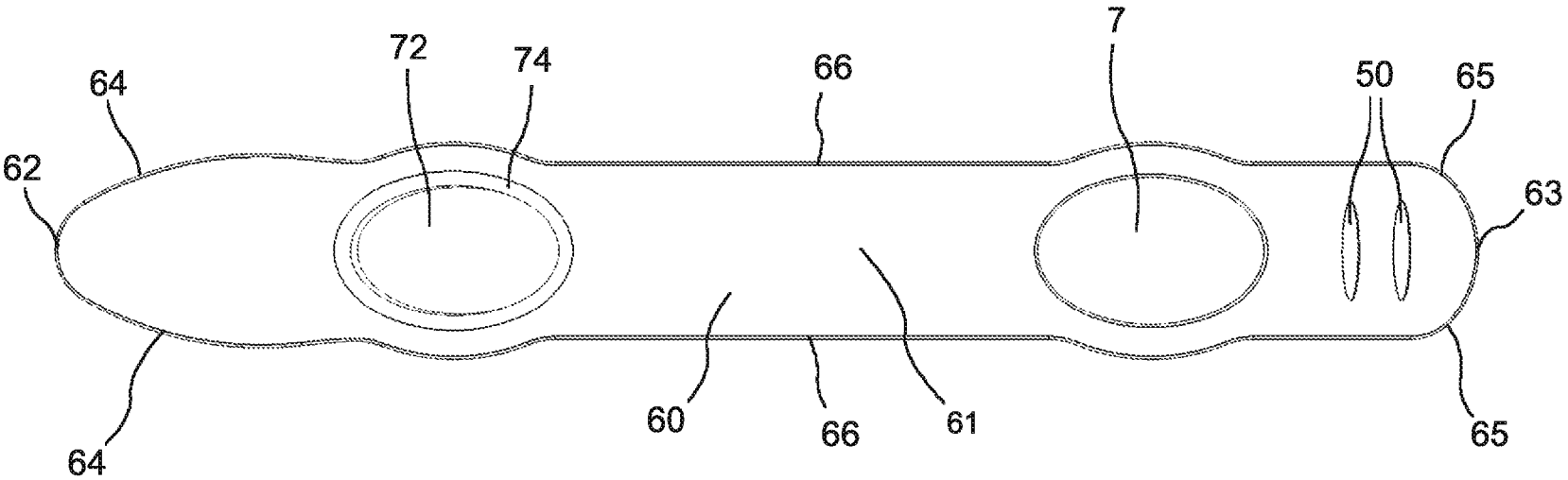
FIG. 3 is a bottom plan view of the preferred embodiment of the present invention.

Referring now to FIG. 1, a preferred embodiment of the present flexible jewelry cover invention 10 is shown. The flexible jewelry cover 10 is an elongate strip preferably made of silicone or a similarly flexible yet durable material that feels comfortable against a user's skin and will not puncture, pierce, snag, or tear additional layers of clothing placed over it. Cover 10 has a top surface 15 with an outer edge, described in detail below, which tapers outwardly and downwardly to bottom surface 60 (as shown in FIG. 3).

At its top surface 15, the shape of the cover 10 is bounded by a first, arch-shaped edge 2 having generally rounded and tapered edges 4, and a second edge 3 having rounded corners 5. The arch-shape indicates which end the user will grip when applying the cover 10 to an appendage. The first edge 2 and its tapered edges 4 define the first portion 20 of the cover 10, and the second edge 3 having rounded corners 5 define the second portion 30. Connecting the two ends 20 and 30 is middle portion 40. Middle portion 40 is bounded on its sides by substantially parallel straight edges 6.

Figure 4:
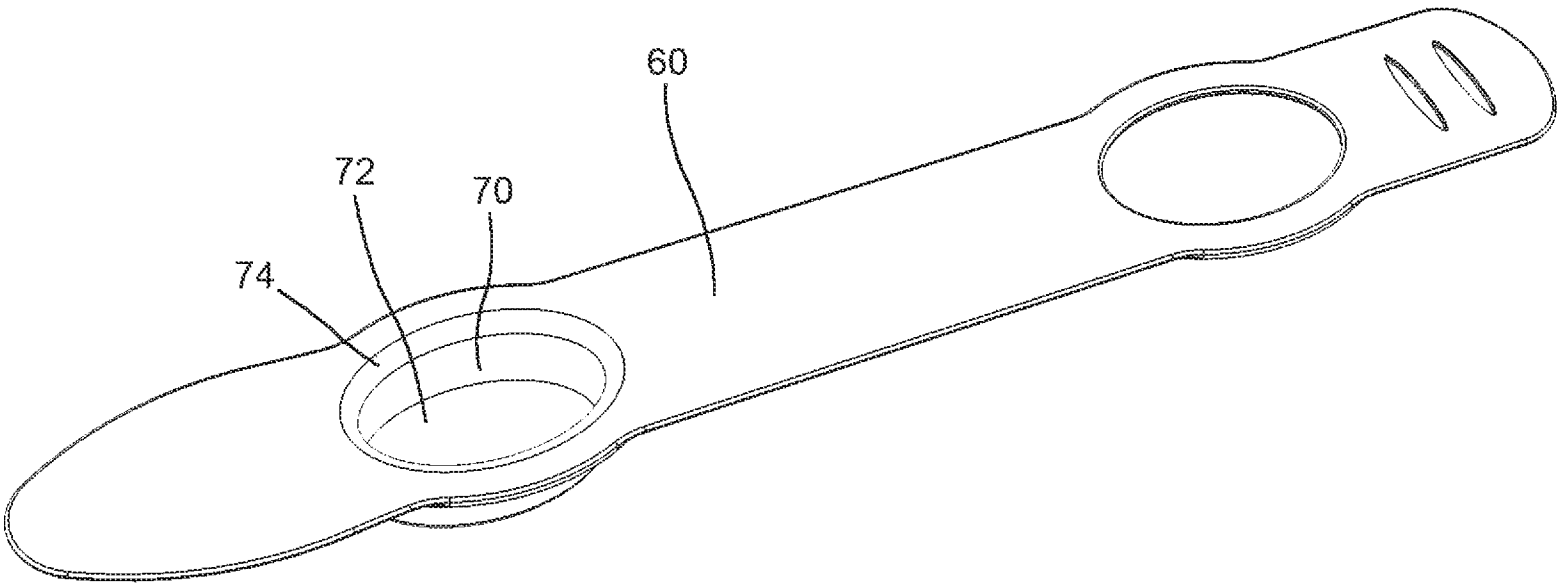
FIG. 4 is a bottom isometric view of the preferred embodiment of the present invention.

Positioned between the first portion 20 and the middle portion 40 is housing 1. Housing 1 can have any cross-sectional shape, provided the cavity defined by the inner walls 70 and inner surface 72 of the housing cap 17 (as shown in FIG. 4) are adapted to accept at least one jewelry article. In the preferred embodiment, housing 1 has a substantially elliptical or oval cross-sectional shape as shown.

Positioned between the second portion 30 and the middle portion 40 is throughhole 7. Throughhole 7 can have any cross-sectional shape, provided it is substantially the same cross-sectional shape as housing 1 as throughhole 7 is adapted to closely receive housing 1. In the preferred embodiment, throughhole 7 has a substantially oval cross-sectional shape as housing 1 has a substantially oval cross-sectional shape.

Surrounding the housing 1 at its base is a base support 19. The base support 19 provides added durability to the housing 1 at its base, further preventing the housing 1 from tearing, shearing, or breaking off the rest of the strip. Base support 19 has generally the same cross-sectional shape as the housing 1. Surrounding the base support 19 is first outer lip 11. First outer lip 11 has generally the same cross-sectional shape as the housing 1 (and, as it follows, base support 19) and extends the outer boundary of the cover 10 at the first outer boundary 13. Found on either side of the strip, first outer boundary 13 bulges out past the outer dimensions of first portion 20 and middle portion 40 established by tapered edges 4 and parallel edges 6, respectively. Similarly, second outer lip 12 surrounds throughhole 7 and extends the outer boundary of the cover 10 at second outer boundary 14. Also found on either side of the strip, second outer boundary 14 bulges out past the outer dimensions of second portion 30 and middle portion 40 established by rounded corners 5 and parallel edges 6, respectively.

The lips 11 and 12 and outer boundaries 13 and 14 have generally the same shape as the cross-sectional shape of housing 1 and throughhole 7, respectively. As shown in FIG. 1, first outer lip 11 is generally oval shaped and first outer boundary 13 is generally arcuate as the cross-sectional shape of housing 1 is substantially an oval. Second outer lip 12 is generally oval shaped and second outer boundary 14 is generally arcuate as the cross-sectional shape of throughhole 7 is substantially an oval.

First portion 20, first outer lip 11, middle portion 40, second outer lip 12, and second portion 30 are all coplanar and past of the top surface 15.

Figure 2:
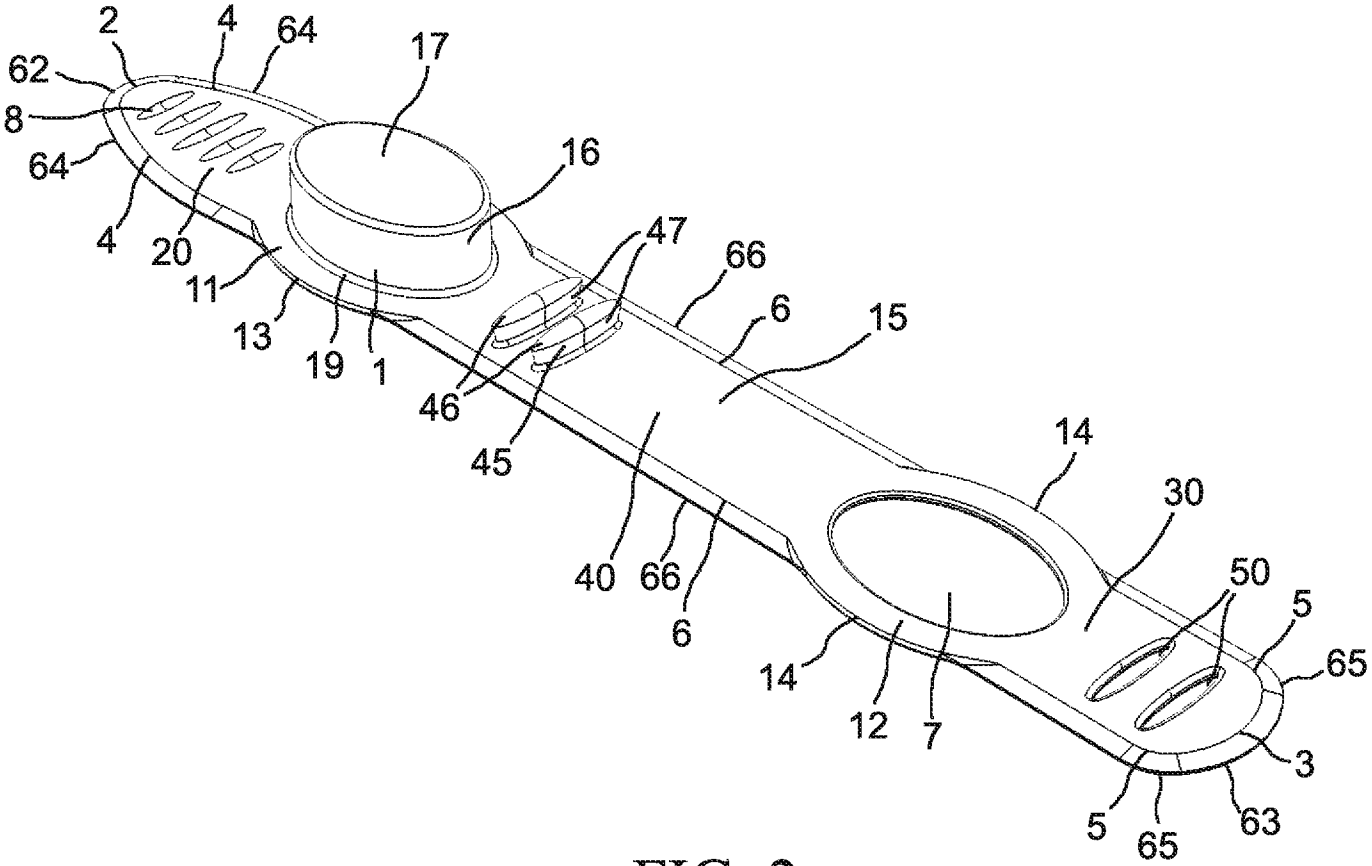
FIG. 2 is a top isometric view of the preferred embodiment of the present invention.

Housing 1 is bounded on all sides by a wall 16 (as shown in FIG. 2), said wall 16 protruding from the top surface 15. The walls 16 terminate at the housing cap 17. The cap 17 is the first element of the cover 10 to extend through throughhole 7 when the cover 10 is in use.

FIG. 1 also depicts the top surfaces 46 of protrusions 45 (shown in full in FIG. 2). The top surfaces 46 cap off the protrusion walls 47 (shown in FIG. 2). In the preferred embodiment shown in FIG. 1, the cross-sectional shape of the protrusions 45 is generally elongate and oval shaped. The protrusions 45 are positioned near the housing 1 but opposite the first edge 2, and are instead oriented in the middle portion 40 between parallel straight edges 6.

Shown in FIGS. 1 and 2 are the openings 50, each of which has substantially the same cross-sectional shape as the protrusions 45 as they are adapted to closely receive the protrusions 45 when the cover 10 is in use. The openings 50 are positioned on the second portion 30 between throughhole 7 and second edge 3. There is at least one opening 50 for every protrusion 45. In the preferred embodiment there is at least one protrusion 45, and as it follows, at least one opening 50. In many embodiments, both the protrusions 45 and openings 50 are laterally disposed relative to the strip, i.e. they are generally oriented at a right angle relative to the parallel edges 6 of the strip.

Additional elements located on first portion 20 are grips 8. Many embodiments contain a plurality of at least one grip 8 which help the user apply the cover 10 over a jewelry article and to an appendage. Grips 8 can extend from the top surface 15, albeit it not as far as housing 1 or protrusions 45, or they may recess into the cover 10. Recessed grips 8 do not recess longitudinally through the entire thickness of the strip. Grips 8 do not need to be an exact shape; the grips 8 shown in FIG. 1 are substantially the same shape as protrusions 45. One grip 8 does not need to be the exact same shape and dimension as another. Shown in the drawings is a plurality of five grips 8. The grips 8 are arranged such that their center lines 9 that bisect them are collinear. This is not required, as any configuration or orientation that assists the user in applying the cover 10 to the jewelry article appendage is acceptable.

FIG. 2 shows the preferred embodiment at an isometric angle. At this view, the walls 16 of housing 1 as well as the walls 47 of protrusion 45 are seen. Further, a clearer view of base support 19 surrounding housing 1 is seen. As shown in FIGS. 2 and 3, the shape of the cover 10 is bounded at its bottom surface by an arch-shaped, first bottom edge 62 with bottom tapered edges 64, and a second bottom edge 63 having bottom rounded corners 65.

FIG. 3 depicts a plan view of the bottom surface 60 of cover 10. In addition to the elements that comprise the bottom, outer edge of the strip, FIG. 3 shows the inner surface 72 of housing cap 17. Further, FIG. 3 shows the opposite sides of openings 50; in this drawing, the openings 50 are not capped (see FIGS. 5 and 6 for capped openings 55). The opposite side of throughhole 7 is also observable. Many embodiments of the strip include the chamfered edge 74. The middle portion 61 of bottom surface 60 is bounded by substantially straight, parallel edges 66. Chamfered edge 74 tapers inwardly into the cavity and provides connection of the inner wall 70 to bottom surface 60. This connection is best seen in the isometric view of FIG. 4, in which inner surface 72, inner walls 70, and chamfered edge 74 are all viewable.

Figure 5:
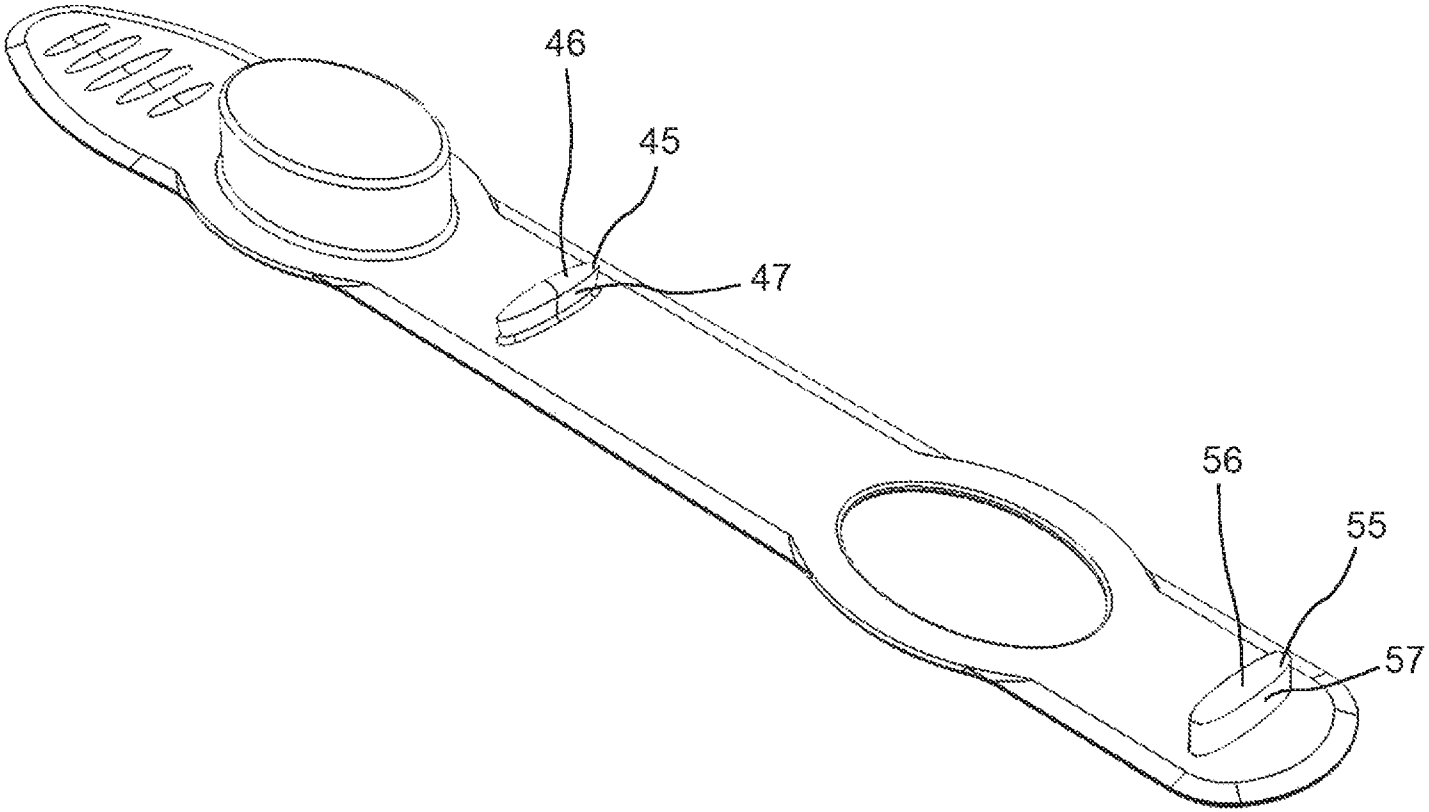
FIGS. 5-6 are top isometric views of alternate embodiments with alternate securement means.
Figure 6:
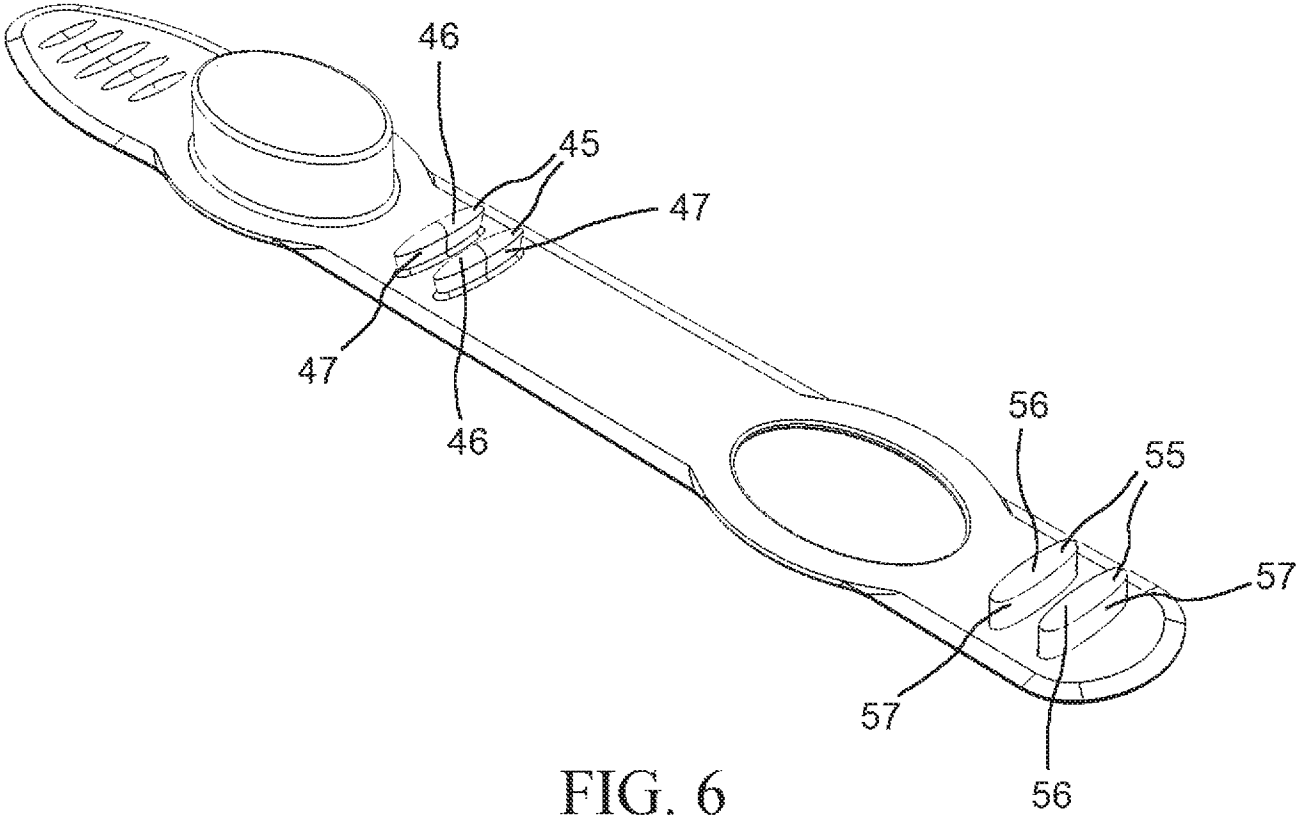

FIGS. 5 and 6 depict an alternate embodiment of the present invention complete with capped openings 55. These caps have outer walls 57, similar to the outer walls 47 of the protrusions, as well as a top 56, analogous to the top 46 of the protrusions 45. These outer walls 57 extend from the second portion 30. The capped openings 55 have a cross-sectional shape substantially the same as the cross-sectional shape as the protrusions 45, and as it follows, the openings 50. The openings 50 are not sealed in the capped embodiments, but instead provide the opening through the strip that accepts the protrusions 45. These openings 50 in the bottom surface 60 are best shown in FIG. 3. FIG. 5 depicts the simplest embodiment, in which the cover 10 features one protrusion 45 and one capped opening 55. FIG. 6 shows another alternate embodiment, complete with multiple protrusions 45 and multiple capped openings 55. The more protrusions and capped openings 55, the better the securement around the jewelry article and the user's appendage.

Figure 7:
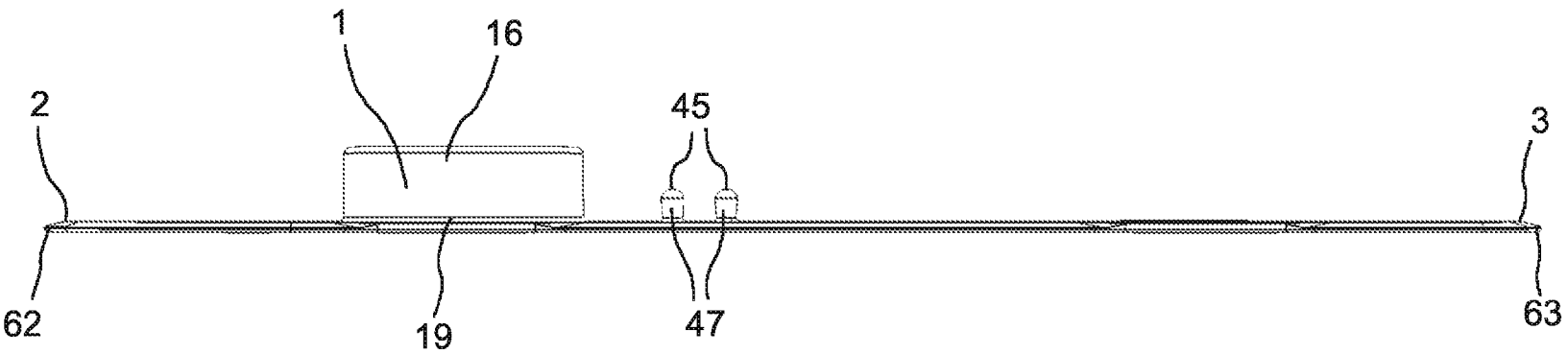
FIG. 7 is an elevation view of the preferred embodiment of the present invention.

FIG. 7 provides an elevation view of the preferred embodiment of the present invention. The outer wall 16 of housing 1, protrusions 45, and the protrusion outer walls 47 are seen extending from the top surface 15. Bounding the base of housing 1 is base support 19. Along the bottom surface, first bottom edge 62 and second bottom edge 63 are seen at opposite sides of the strip. Along the top surface, first edge 2 and second edge 3 are also viewed at opposite sides of the strip. This drawing also depicts an elevation view of embodiments in which grips 8 are recessed into the strip.

Figure 8:
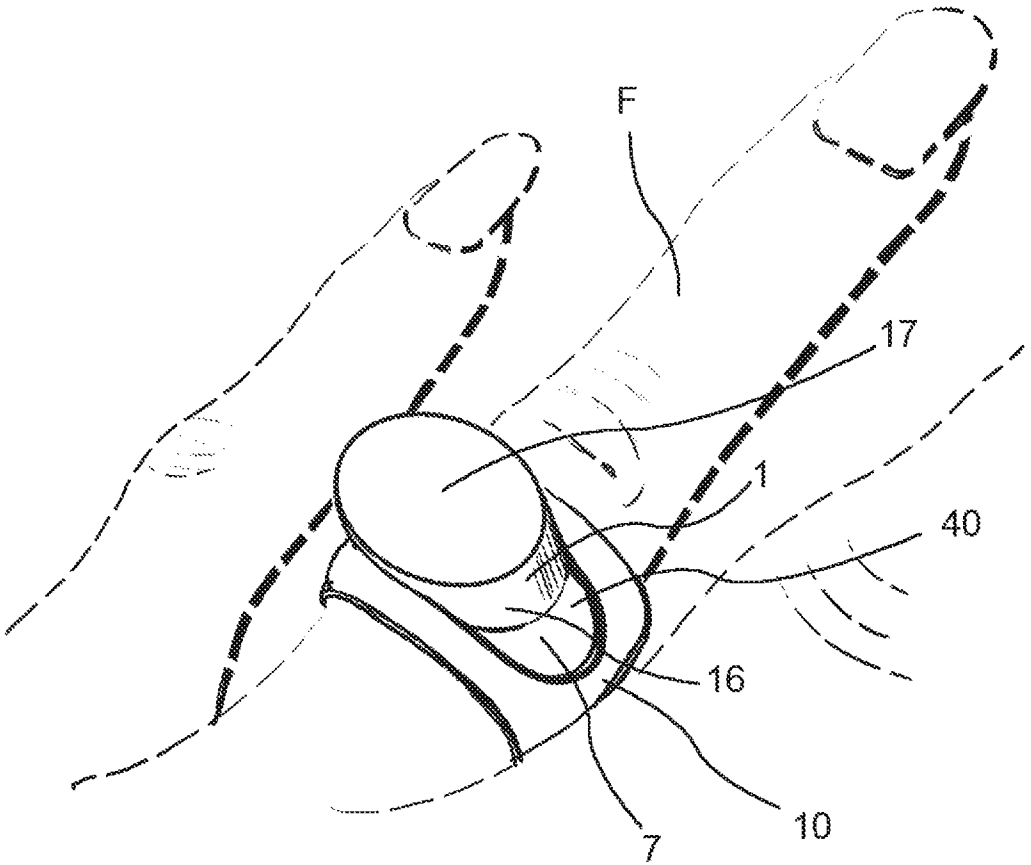
FIG. 8 is an environmental view of the present invention in use on a user's finger.

FIG. 8 shows the present invention while in use. Here, the cover 10 is wrapped around a user's appendage, depicted as a finger F. The cavity inside housing 1 defined by inner walls 70 and inner surface 72 completely encapsulates a jewelry article worn on finger F. The cover 10 then wraps around the support element for the jewelry article, which would be a ring or similar finger-worn accessory in this embodiment, until the support element is also covered. Throughhole 7 is wrapped around with the rest of the strip and housing 1 is inserted through it, housing cap 17 the first element of housing 1 to extend through throughhole 7. Throughhole 7 is stretched and in direct contact with outer wall 16. In this drawing, middle portion 40 is seen through a stretched portion of throughhole 7. Additional securement means are not pictured in this drawing.

Figure 9:
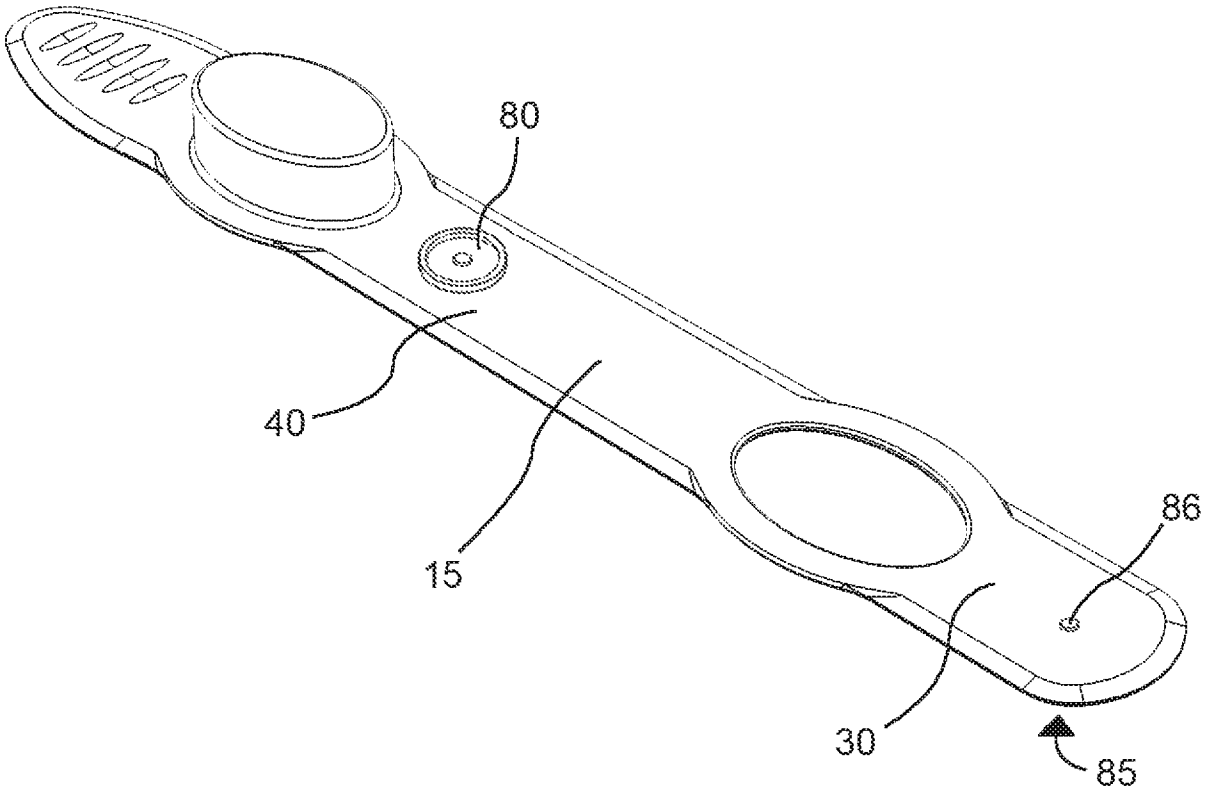
FIGS. 9-12 are top isometric views of alternate embodiments with alternate securement means.

FIGS. 9-12 feature alternate embodiments of the present invention, each with a different securement means different than the protrusion-and-opening configuration previously described. FIG. 9 depicts a snap securement means 80 affixed to the top surface 15 of cover 10. In this drawing, snap means 80 is positioned on the side of the housing 1 where the protrusions 45 are located in the preferred embodiment. Snap means 80 can be positioned throughout anywhere middle portion 40 provided the jewelry article is protected when the cover 10 is in use. The snap insert 85 extends from the bottom surface 60 so that it can engage the snap means 80 when in use. The securing element 86 that affixes the snap insert 85 into the strip is shown protruding through second portion 30.

Figure 10:
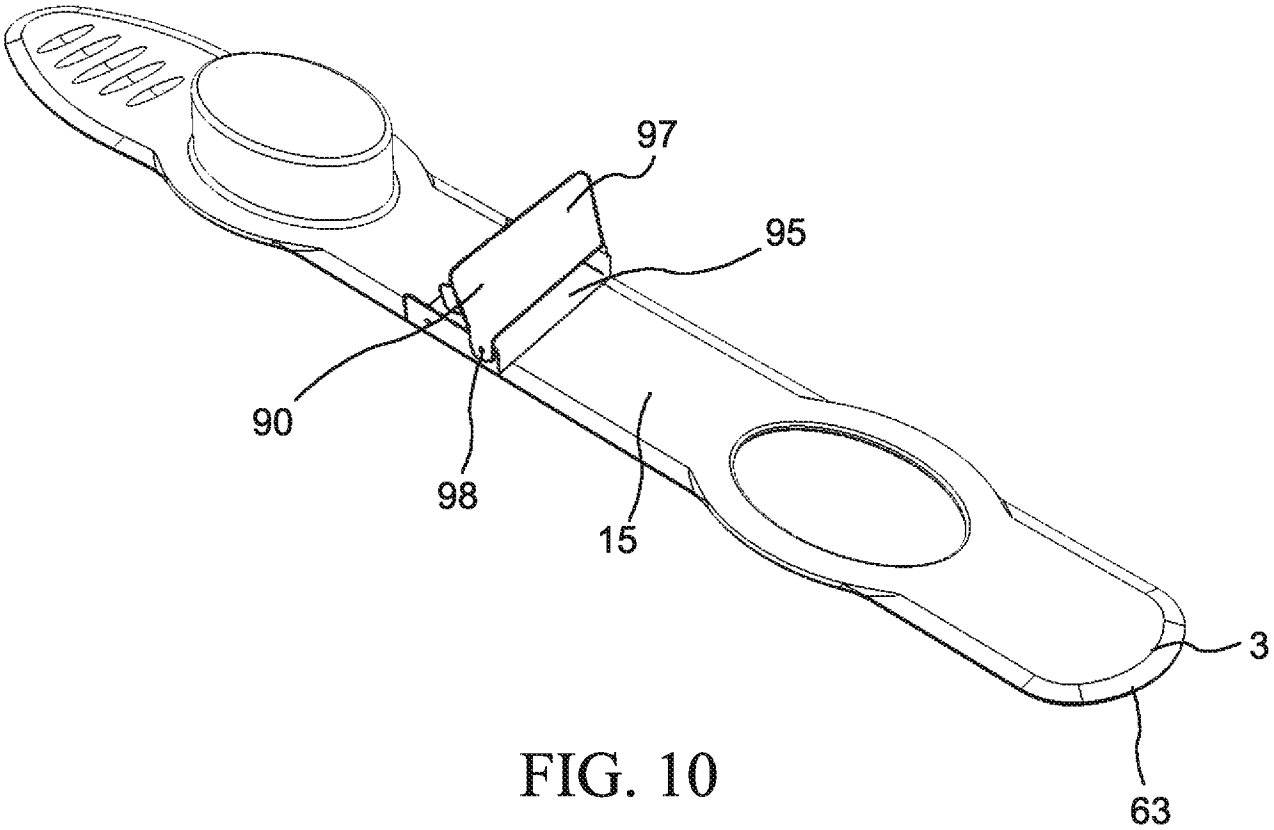

FIG. 10 depicts a clasp 90 as the securement means, said clasp 90 positioned on the side of the housing 1 where the protrusions 45 are located in the preferred embodiment. Clasp 90 can be positioned anywhere throughout middle portion 40 provided the jewelry article is protected when the cover 10 is in use. The edge of the strip defined by second edge 3 and second bottom edge 63 is fed through the opening 95 when the cover 10 is in use. After this edge is fed through opening 95, the user closes the clasp latch 97 by backwardly rotating it about hinge 98. Once the clasp latch 97 is tight enough that it cannot move, but is still comfortable to the user, the cover 10 is secured.

Figure 11:
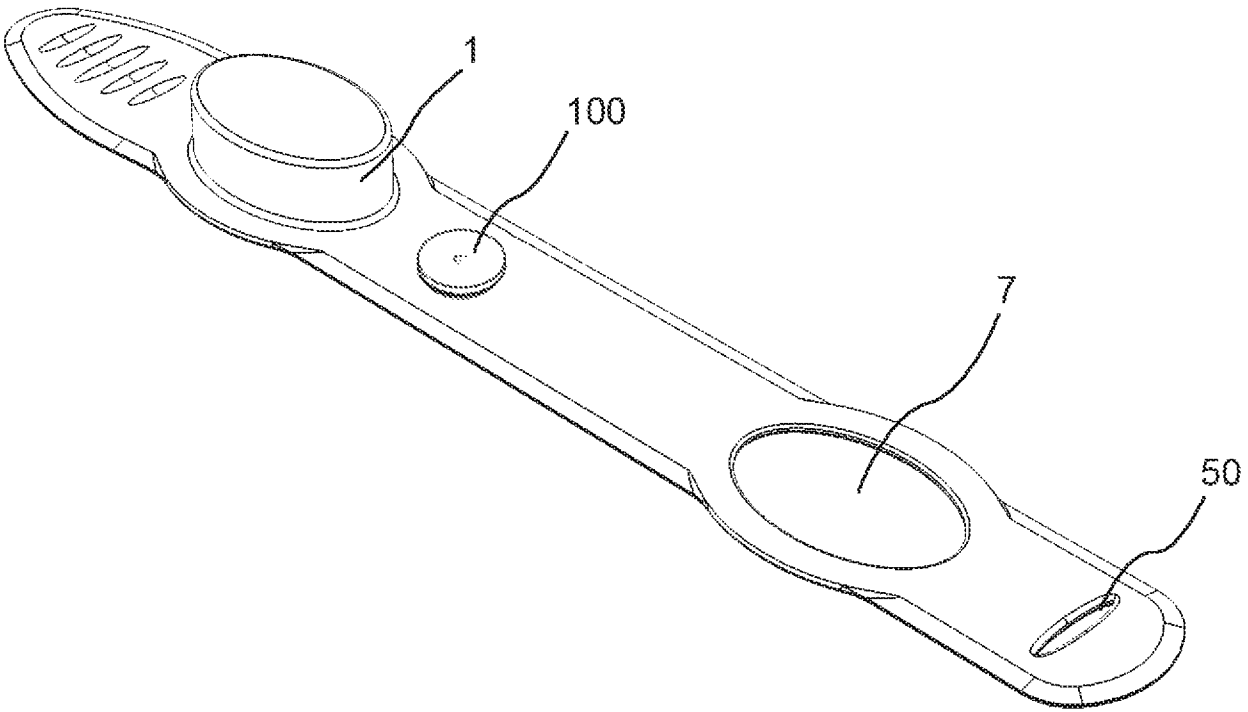

FIG. 11 depicts the securement means as a button 100. In this drawing, button 100 is affixed to the top surface 15 and positioned on the side of the housing 1 where the protrusions 45 are located in the preferred embodiment. Button 100 can be positioned anywhere throughout middle portion 40 provided the jewelry article is protected when the cover 10 is in use. Opening 50, previously adapted to closely receive the protrusion 45, is now adapted to wrap around button 100. When the cover 10 is in use, housing 1 will extend through throughhole 7, and the user will place opening 50 around the button 100. In this embodiment, the opening 50 is not capped.

Figure 12:
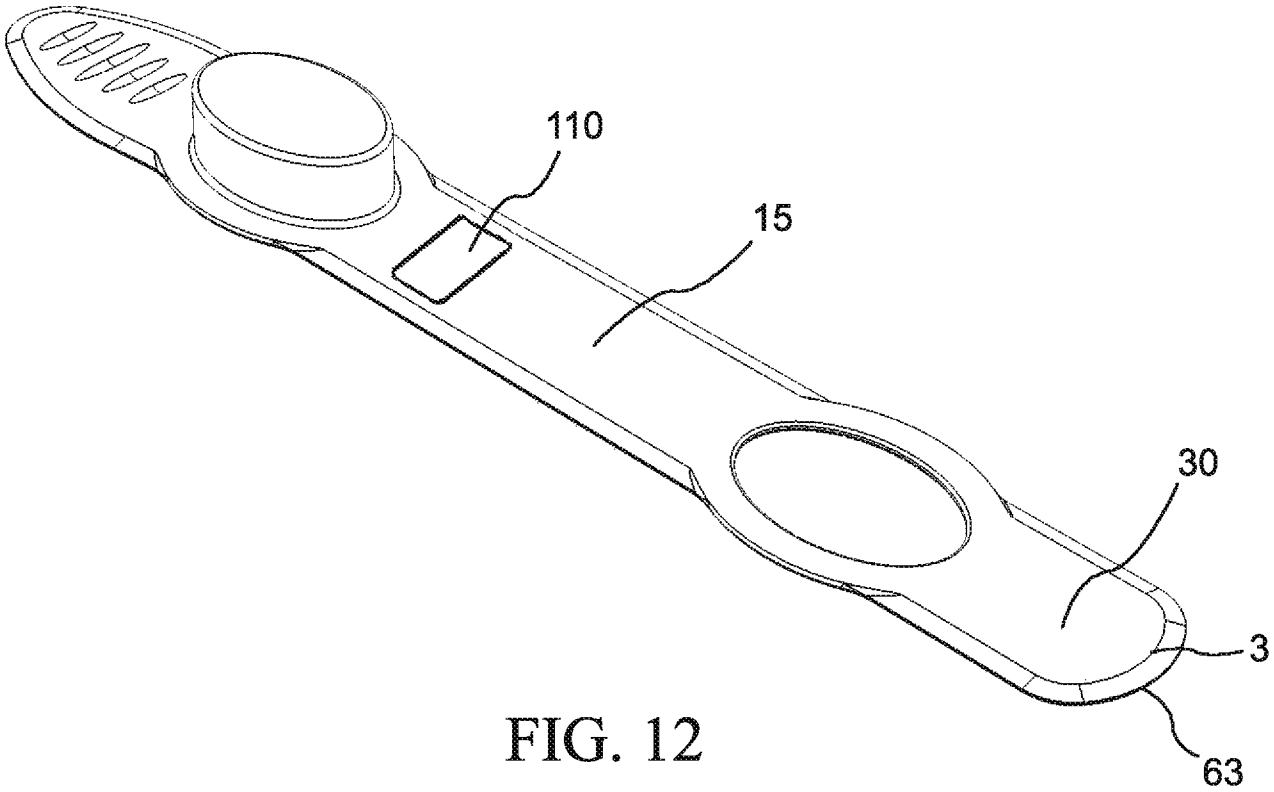

FIG. 12 depicts an adhesive 110 placed on the top surface of the strip 15 as an alternate securement means. In this drawing, adhesive 110 positioned on the side of the housing 1 where the protrusions 45 are located in the preferred embodiment. Adhesive 110 can be positioned anywhere throughout middle portion 40 provided the jewelry article is protected when the cover 10 is in use. When the strip is in use, and the housing 1 has extended through throughhole 7, the user presses the free end of the strip, i.e. the edge of the strip defined by second edge 3 and second bottom edge 63, to the adhesive 110 for securement. Pressing the strip together allows the bottom surface 60 of the strip to adhere to the top surface 15. The adhesive 110 may be resealable as needed. Alternatively, the strip itself may be self-adhesive. There may be another adhesive section 110 on the bottom surface 60 positioned where the openings 50 are located in the preferred embodiment. This extra section of adhesive would provide even greater securement when the strip is in use. The user would press the ends together in the same manner as if there were only one adhesive section.

Figure 13:
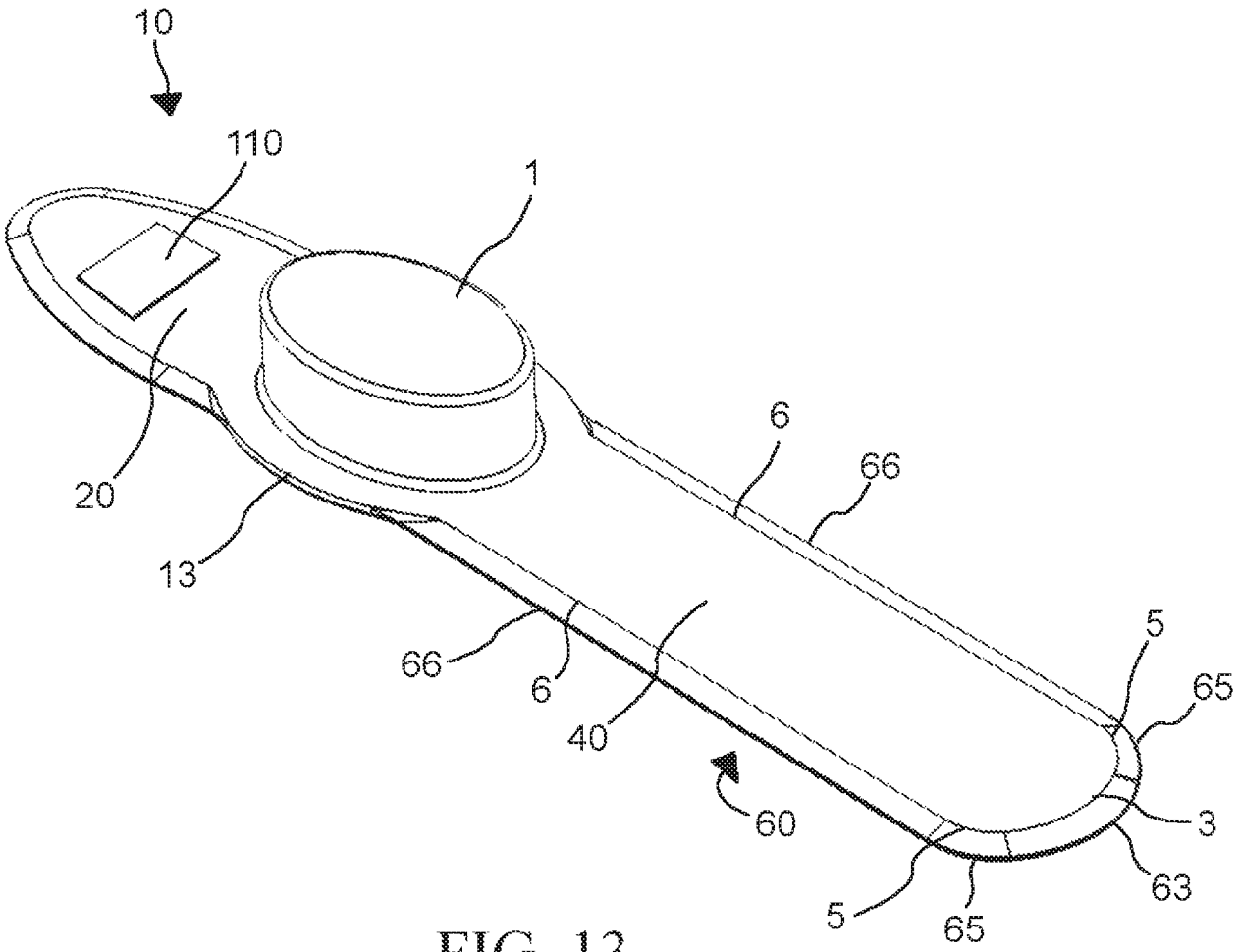
FIG. 13 is a top isometric view of an alternate embodiment without the throughhole configuration.

FIG. 13 provides yet another alternative embodiment which does not employ a throughhole. Instead, the cover 10 securement means utilizes an alternative securement means, such as a snap, clasp, button, or adhesive as depicted in FIGS. 9-12. For illustrative purposes, FIG. 13 shows use of the adhesive 110, wherein the adhesive 110 is positioned on the first portion 20 as opposed to being on middle section 40, i.e. the side of the housing 1 where the protrusions 45 are located in the preferred embodiment as shown in FIG. 12.

Here, the housing 1 accepts at least one jewelry article and any elements extending from it, and the strip wraps around the appendage just as in the preferred embodiments. However, the far end of the strip defined by the second edge 3 and bottom edge 63 wrap around the appendage and terminate at first portion 20. The user then presses the free end of the strip to the adhesive 110 in a similar fashion as the embodiment depicted in FIG. 12. Pressing the strip together allows the bottom surface 60 of the strip to adhere to the top surface 15. Alternatively, the strip itself may be self-adhesive. With no throughhole, no part of the strip closely receives housing 1. Further, the strip may be much shorter than in other embodiments, as depicted by a condensed middle section 40.

Similar to the embodiment featured in FIG. 12, the adhesive 110 may be resealable as needed. There may be another adhesive section 110 on the bottom surface 60 positioned where the openings 50 would be located in the preferred embodiment. This extra section of adhesive would provide even greater securement when the strip is in use. The user would press the ends together in the same manner as if there were only one adhesive section, or if the strip were configured in the same way as previously disclosed.

It should be understood, of course, that the foregoing relates to exemplary embodiments of the invention and that modifications may be made without departing from the spirit and scope of the invention as set forth in the following claims.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A flexible jewelry cover comprising:

a resilient elongate strip having a first end, a second end, a top side, and a bottom side, wherein said strip is adapted to wrap around a user's finger, thereby covering a ring worn on a user's finger;

a housing extending from said top side wherein said housing is integral with said strip and wherein said housing is adapted to accept at least one protruding element of said ring; and a throughhole in said strip positioned between the housing and the second end and adapted to closely receive said housing.

2. The cover of claim 1 further comprising a securement means wherein the securement means comprises at least one protrusion extending from said top side of said strip on said first end of said strip; and at least one receiving means on said second end of said strip wherein said receiving means is adapted to closely receive said at least one protrusion when said cover is in use.

3. The cover of claim 2 wherein said receiving means is at least one opening in said strip adapted to closely receive said at least one protrusion.

4. The cover of claim 3 wherein said at least one protrusion and said at least one opening are elongate and laterally disposed relative to said strip.

5. The cover of claim 2 wherein said securement means is a snap.

6. The cover of claim 2 wherein said securement means is a button.

7. The cover of claim 2 wherein said receiving means is at least one recess in said bottom side of said strip adapted to closely receive said at least one protrusion.

8. The cover of claim 7 wherein said at least one protrusion and said at least one recess are elongate and laterally disposed relative to said strip.

9. The cover of claim 1 further comprising a clasp connected to the strip between the housing and the throughhole.

10. The cover of claim 1 wherein said strip is made of silicone.

11. The cover of claim 1 wherein said strip is made of rubber.

12. The cover of claim 1 wherein said strip is made of plastic.

13. The cover of claim 1 wherein said strip is made of fabric.

14. The cover of claim 1 wherein said strip is self-adhesive.

15. The cover of claim 1 wherein said bottom side of said strip adheres to said top side of said strip when said bottom side and said top side are pressed together.

16. A flexible jewelry cover comprising:

a resilient elongate strip having a first end, a second end, a top side and a bottom side, wherein said strip is adapted to wrap around a user's finger, thereby covering a ring worn on a user's finger;

a housing extending from said top side wherein said housing is integral with said strip and wherein said housing is adapted to accept at least one protruding element of said ring;

a throughhole in said strip positioned between the housing and the second end and adapted to receive said housing;

wherein the strip includes a middle portion between the housing and the throughhole, and wherein the middle portion of the strip includes at least one securing protrusion; and at least one opening in the strip between the throughhole and the second end, wherein the at least one opening is adapted to receive the at least one securing protrusion.

17. The cover according to claim 16, wherein the middle portion has a length, and a user's finger has a circumference, and wherein the length of the middle portion is at least as long as a majority of the circumference of a user's finger.

18. A ring cover comprising:

a resilient strip having a first end and a second end, a top side and a bottom side, wherein said strip is adapted to wrap around a user's finger, thereby covering a ring worn on a user's finger;

a housing extending from the top side between the first end and the second end, wherein the housing is integral with said strip and wherein said housing is adapted to accept at least one protruding element of the ring; and a throughhole in said strip positioned between the housing and the second end and adapted to receive said housing.

19. The cover according to claim 18, wherein the strip includes a middle portion with a length between the housing and the throughhole, and wherein the user's finger has a circumference, and wherein the length of the middle portion is at least as long as a majority of the circumference of the user's finger.

* * * * *